US008544306B2

(12) United States Patent
Higashida et al.

(10) Patent No.: US 8,544,306 B2
(45) Date of Patent: Oct. 1, 2013

(54) PLUG, PIERCING-ROLLING MILL, AND METHOD OF PRODUCING SEAMLESS TUBE BY USING THE SAME

(75) Inventors: Yasuto Higashida, Osaka (JP); Yasuyoshi Hidaka, Osaka (JP); Kazuhiro Shimoda, Osaka (JP); Tomio Yamakawa, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 34 days.

(21) Appl. No.: 13/212,929

(22) Filed: Aug. 18, 2011

(65) Prior Publication Data

US 2012/0210761 A1 Aug. 23, 2012

(30) Foreign Application Priority Data

Mar. 3, 2009 (JP) ..... 2009-049442
Apr. 30, 2009 (JP) ..... 2009-111068

(51) Int. Cl.
*B21B 19/04* (2006.01)

(52) U.S. Cl.
USPC ..... 72/97; 72/208

(58) Field of Classification Search
USPC ..... 72/41, 43, 44, 45, 97, 208, 209, 236, 72/462, 476, 46, 47
See application file for complete search history.

(56) References Cited

U.S. PATENT DOCUMENTS 2,167,424 A * 7/1939 Novack ..... 72/45
4,393,677 A 7/1983 Tamura et al.
4,466,265 A * 8/1984 Wessel ..... 72/97
5,958,521 A * 9/1999 Zaluzec et al. ..... 427/449
6,863,931 B2 * 3/2005 Someno et al. ..... 427/456
8,333,092 B2 * 12/2012 Shimoda et al. ..... 72/97
2010/0089111 A1 * 4/2010 Shimoda et al. ..... 72/97

FOREIGN PATENT DOCUMENTS

| | | | |
|---|---|---|---|
| CA | 1147615 | A1 | 6/1983 |
| CN | 101198420 | A | 6/2008 |
| DE | 3048691 | A1 | 9/1981 |
| EP | 1908533 | A1 | 4/2008 |
| FR | 2472423 | A1 | 7/1981 |
| GB | 2069904 | A | 9/1981 |
| IT | 1143903 | B | 10/1986 |
| JP | 51-133167 | A | 11/1976 |
| JP | 56-091912 | A | 7/1981 |

(Continued)

OTHER PUBLICATIONS

International Preliminary Report of Patentability for PCT/JP2010/050668, dated Sep. 13, 2011.

*Primary Examiner* — Edward Tolan
(74) *Attorney, Agent, or Firm* — Marshall, Gerstein & Borun LLP

(57) ABSTRACT

A plug includes a front edge portion having a convex curvature; a cylindrical portion having a truly or nearly cylindrical shape; a trunk portion having an outer diameter gradually increasing toward a rear edge thereof; a mandrel joint provided in a rear edge portion of the plug; a lubricant ejection hole running through the trunk portion from the mandrel joint that opens on the surface of the cylindrical portion; and a coating comprising oxides and Fe that is formed on the base metal surface of each of the front edge portion as well as the trunk portion by arc spraying using an iron wire. In this way, the plug can prevent inner surface flaws from occurring in a hollow blank that is deformed by piercing-rolling, and can extend its life without requiring a long time for making it.

8 Claims, 9 Drawing Sheets

(56) References Cited

FOREIGN PATENT DOCUMENTS

| | | | | |
|---|---|---|---|---|
| JP | 58-116910 | | * | 7/1983 |
| JP | 58-168405 | | * | 10/1983 |
| JP | 59-013924 | A | | 1/1984 |
| JP | 60-130406 | | * | 7/1985 |
| JP | 60-208458 | A | | 10/1985 |
| JP | 62-259603 | | * | 11/1987 |
| JP | 63-154207 | | * | 6/1988 |
| JP | 63-282241 | A | | 11/1988 |
| JP | 1-180712 | A | | 7/1989 |
| JP | 2-224805 | | * | 9/1990 |
| JP | 3-204106 | | * | 9/1991 |
| JP | 04-074848 | A | | 3/1992 |
| JP | 04-270003 | A | | 9/1992 |
| JP | 10-235413 | A | | 9/1998 |
| JP | 10-249412 | A | | 9/1998 |
| WO | WO 2006/134957 | A1 | | 12/2006 |

* cited by examiner

PLUG, PIERCING-ROLLING MILL, AND METHOD OF PRODUCING SEAMLESS TUBE BY USING THE SAME

TECHNICAL FIELD

The present invention relates to a plug that is used in a piercing-rolling mill (hereafter, also referred to as a "piercing machine (piercer)") for producing seamless tubes. The present invention also relates to a piercing machine with the plug, and a method of producing a seamless tube by using the piercing machine.

BACKGROUND ART

A seamless tube can be produced by the Mannesmann tube-making process. This tube-making process comprises the following steps:

(1) piercing-rolling a starting material (round billet), which is heated to a predetermined temperature, by a piercing machine to deform the same into a hollow blank (hollow shell);

(2) elongation-rolling the hollow blank by a elongation-rolling mill (for example, a mandrel mill); and (3) sizing-rolling the hollow blank, which has been subjected to elongation-rolling, by a sizing mill (for example, a stretch reducer).

FIG. 1 is a schematic diagram to illustrate the piercing-rolling of a starting material by a conventional piercing machine. As shown in the drawing, the piercing machine includes a pair of conical rolls 4 each of which is inclined with respect to a pass line PL, a bullet-shaped plug 100 as a piercing tool, and a mandrel 3 that is coupled with the rear part of the plug 100. A starting material 7 is fed in an axial direction while being rotated in a circumferential direction by the conical rolls 4. At this time, the starting material 7 is pierced in the central portion thereof by the plug 100 to form a hollow blank 8.

During piercing-rolling by the piercing machine, flaws may occur in the inner surface of the hollow blank (hereafter, referred to as "inner surface flaws"). The principal mechanism of the occurrence of inner surface flaws is as follows. A rotary forging effect during piercing causes Mannesmann fracture to occur in the central portion of starting material on the upstream side of the front edge of plug. The resultant Mannesmann fracture is subjected to shear strain in a circumferential direction by the conical rolls and the plug. As a result, the Mannesmann fracture propagates in a circumferential direction to grow into inner surface flaws.

In order to suppress the occurrence of inner surface flaws due to the Mannesmann fracture, it is effective to reduce the friction coefficient of the plug surface. The reason is as described below. Reducing the friction coefficient of the plug surface will increase the feeding speed of the starting material to be pierced, thereby suppressing the rotary forging effect. Moreover, reducing the friction coefficient of the plug surface will suppress the shear strain in a circumferential direction. The suppression of the rotary forging effect and the shear strain can prevent the development of the Mannesmann fracture, thereby enabling the suppression of the occurrence of inner surface flaws.

The reduction of the friction coefficient of the plug surface also contributes to the prevention of the wear and melting loss of the plug. Accordingly, it becomes possible to prevent the formation of concavo-convex irregularities on the plug surface, and also to suppress the occurrence of inner surface flaws due to the concavo-convex irregularities.

Conventional arts for reducing the friction coefficient of the plug surface include the followings.

Patent Literatures 1 and 2 disclose a method of piercing-rolling in which, using a plug provided with an ejection hole that opens in the front edge of the plug, piercing-rolling is performed while a lubricant is injected from the ejection hole. However, the front edge of the plug disclosed in those Patent Literatures 1 and 2 comes into contact with the starting material at a high interfacial pressure. For that reason, in order to inject the lubricant from the ejection hole that opens in the front edge of plug, it is necessary to inject the lubricant at a pressure higher than the deformation resistance of the starting material in contact with the front edge of plug. Further, the opening of the ejection hole may be deformed and clogged due to the contact with the starting material.

Patent Literature 3 discloses a method of injecting a lubricant from a plug without using a highly pressurized lubricant.

FIG. 2 is a longitudinal sectional view of the plug disclosed in Patent Literature 3. As shown in the drawing, the plug 101 disclosed in Patent Literature 3 includes a front edge portion 102 having a convex curvature, a cylindrical portion 103 having a constant outer diameter, and a trunk portion 104 having an outer diameter that gradually increases toward the rear edge thereof. The ejection hole 105 opens at the front part of the trunk portion 104, adjacent to the cylindrical portion 103. When piercing-rolling is performed by using the plug 101, a gap 60 is formed between the surface of the cylindrical portion 103 and the starting material 7. Patent Literature 3 states that the gap 60 prevents the opening of the ejection hole 105 from being clogged, allowing the supply of a predetermined amount of lubricant oil. However, this plug 101 has the following problems.

During piercing, the starting material 7 may come into contact with an upper portion of the opening 105*a* of the ejection hole 105. This is because the ejection hole 105 opens at the front part of the trunk portion 104, adjacent to the cylindrical portion 103. When the starting material 7 comes into contact with the opening 105*a* of the ejection hole 105, inner surface flaws may occur in the hollow blank 8, or the opening 105*a* may undergo melting loss and may be clogged.

During piercing, the starting material 7 comes into contact with the vicinity of the opening 105*a* of the ejection hole 105 in the trunk portion 104. In association with the contact, the temperature at the opening 105*a* of the ejection hole 105 is raised to an elevated temperature by the heat retained by the starting material 7. Therefore, when a glass-based lubricant is used, the lubricant becomes high temperature in the vicinity of the opening 105*a* during piercing, leading up to the evaporation of water and the emergence of a glass component. Thus, it may happen that the glass component solidifies in the vicinity of the opening 105*a* when the plug is cooled after piercing, thereby causing the ejection hole 105 to be clogged.

Patent Literature 4 discloses a method of solving the problem of the plug disclosed in Patent Literature 3 described above.

FIG. 3 is a diagram to illustrate the plug disclosed in Patent Literature 4, whereas FIG. 3A is a longitudinal sectional view of the plug, and whereas FIG. 3B is a longitudinal sectional view to illustrate how piercing-rolling undergoes. As shown in FIG. 3A and FIG. 3B, the plug 120 disclosed in Patent Literature 4 is configured such that a cylindrical portion 122 is provided between a front edge portion 121 and a trunk portion 123, and an ejection hole 124 opens on the surface of the cylindrical portion 122. When piercing-rolling is performed using the plug 120, a gap 60 is formed between the starting material 7 and the surface of the cylindrical portion 122 as shown in FIG. 3B. The gap 60 prevents the opening

124*a* of the ejection hole 124 from contacting the starting material 7 during piercing. Therefore, it is possible to prevent the occurrence of inner surface flaws due to the contact between the starting material 7 and the opening 124*a* of the ejection hole 124, and also to prevent the opening 124*a* from suffering melting loss and being clogged.

During piercing, the rise of the temperature at the opening 124*a* of the ejection hole 124 is suppressed. This is because the ejection hole 124 does not open at the front edge portion 121 or the trunk portion 123, either of which is in contact with the starting material 7. In this way, even when a glass-based lubricant is used, it is possible to inhibit the lubricant from solidifying in the vicinity of the opening 124*a* of the ejection hole 124, and to prevent the ejection hole 124 from being clogged by the solidified lubricant.

In the meanwhile, the plug disclosed in Patent Literature 4 described above, which has an ejection hole for injecting a lubricant, is required to have a long life since it is intended to repetitively be used for piercing. Due to this requirement, a coating of oxide scale is usually formed on the plug surface for the protection of the plug base metal (see, for example, Patent Literatures 5 to 8). The scale coating serves to insulate the heat transfer from the billet to the plug base metal and to prevent seizing between the billet and the plug during piercing. In this way, damage and melting loss of the plug base metal is suppressed and it is expected that the life of plug extends.

CITATION LIST

Patent Literature

Patent Literature 1: Japanese Patent Application Publication No. 1-180712

Patent Literature 2: Japanese Patent Application Publication No. 10-235413

Patent Literature 3: Japanese Patent Application Publication No. 51-133167

Patent Literature 4: National Republication of International Patent Application No. WO2006/134957

Patent Literature 5: Japanese Patent Publication No. 4-8498

Patent Literature 6: Japanese Patent Application Publication No. 4-74848

Patent Literature 7: Japanese Patent Application Publication No. 4-270003

Patent Literature 8: Japanese Patent Publication No. 64-7147

SUMMARY OF INVENTION

Technical Problem

In general, the scale coating of the plug surface is formed by heat treating a plug made of a hot working tool steel at a temperature as high as about 900° C. to 1000° C. for several hours to several tens of hours. Therefore, the formation of scale coating requires a large amount of time.

In case of the plug disclosed in Patent Literature 4 described above, a scale grows at the ejection hole due to the heat treatment for forming the scale coating. In this way, the opening of the ejection hole is narrowed by the scale thus formed. Further, forming a thicker scale coating to improve heat insulation performance may result in the cologging of the opening of the ejection hole by the scale. In either case, smooth injection of lubricant becomes difficult due to the scale.

A plug, which has been repetitively used for piercing and in which wear and peeling off of scale coating have occurred, is subjected to a reprocessing heat retreatment for reuse so that the scale coating is reconstituted. When the reprocessing heat treatment is to be performed, a remaining scale coating on the plug surface is completely removed by shotblasting. Therefore, there is a risk that the opening of the ejection hole of the plug is deformed by the effect of shotblasting. Further, the scale that remains in the ejection hole inside the plug cannot be removed by shotblasting. Therefore, as the reprocessing heat treatment is repeated, the ejection hole may be clogged by the scale.

Since the front edge portion of the plug is brought into contact with the starting material of high temperature at a high interfacial pressure for long duration during piercing, the front edge portion is more susceptible to wear and melting loss than other respective parts that constitute the plug. However, in the piercing-rolling using the plug disclosed in Patent Literature 4 described above, since the lubricant injected from the ejection hole flows mostly toward the rear of the plug, it is less likely to flow onto the surface of the front edge portion of plug. For this reason, the supply of lubricant tends to be insufficient in the front edge portion of plug, and it is likely that a sufficient lubrication effect by the lubricant is not possibly achieved.

Therefore, it is difficult for the plug disclosed in Patent Literature 4 described above to effectively suppress the wear and melting loss of the front edge portion, and it is not possible to extend the life of plug.

Further, the plug disclosed in Patent Literature 4 described above cannot extend the life of plug even when scale coating is formed on the surface of base metal. This is because the ejection hole is clogged by a scale when heat treatment or a reprocessing heat treatment for forming a scale coating is performed, or the opening of the ejection hole deforms during shotblasting performed in association with the reprocessing heat treatment, either of which makes it difficult to smoothly inject lubricant.

Further, the plug disclosed in Patent Literature 4 described above has a problem in that the heat treatment of long time duration is required when a scale coating is formed on the surface of base metal, and therefore it takes ages to fabricate the plug.

It is an object of the present invention to provide a plug, a piercing machine, and a method of producing a seamless tube by using the same, which have the following features:

(1) enabling the prevention of inner surface flaws of the hollow blank shaped by piercing-rolling, (2) enabling the extension of the life of plug, and (3) not requiring many hours for the fabrication of the plug.

Solution to Problem

The gist of the present invention is as follows.

(I) A plug for use in a piercing-rolling mill for piercing-rolling a starting material and deforming the same into a hollow blank, the plug being coupled with a front edge of a mandrel and adapted to pierce the starting material while injecting a lubricant, the plug including:

a front edge portion having a convex curvature;

a cylindrical portion having a truly or nearly cylindrical shape and being adjacent to the front edge portion;

a trunk portion having an outer diameter gradually increasing toward a rear edge thereof and being adjacent to the cylindrical portion;

a mandrel joint provided in a rear edge portion of the plug;

a lubricant ejection hole running through the trunk portion from the mandrel joint that opens on the surface of the cylindrical portion; and a coating comprising oxides and Fe that is formed on the base metal surface of each of the front edge portion as well as the trunk portion by arc spraying using an iron wire.

(II) A plug for use in a piercing-rolling mill for piercing-rolling a starting material and deforming the same into a hollow blank, the plug being coupled with a front edge of a mandrel and adapted to pierce the starting material, the plug including:

a front edge portion having a convex curvature;

a trunk portion having an outer diameter gradually increasing toward a rear edge thereof, the trunk portion directly abutting the front edge portion or otherwise having a cylindrical portion of a truly or nearly cylindrical shape lie between them;

a mandrel joint provided in a rear edge portion of the plug; and a coating comprising oxides and Fe that is formed at least on the base metal surface of each of the front edge portion as well as the trunk portion by arc spraying using an iron wire.

The above described plugs of (I) and (II) are preferably configured such that a ratio of regions occupied by the oxides in the coating is 55% to 80%.

The above described plugs of (I) and (II) are preferably configured such that a ratio of regions occupied by the oxides in the coating is not more than 40% in a portion adjacent to the base metal, and 55% to 80% in a surface layer portion.

These plugs are preferably configured such that a thickness of the coating is larger in the front edge portion than in the trunk portion.

(III) A piercing-rolling mill for piercing-rolling a starting material and deforming the same into a hollow blank while injecting a lubricant from a plug coupled with a front edge of a mandrel, the piercing-rolling mill including:

a mandrel having a through hole in an axial direction;

a lubricant supply apparatus for supplying the lubricant to the through hole; and a plug having a lubricant ejection hole in communication with the through hole, wherein the plug comprises a front edge portion having a convex curvature, a cylindrical portion having a truly or nearly cylindrical shape, and a trunk portion having an outer diameter gradually increasing toward a rear edge thereof, the lubricant ejection hole opens on the surface of the cylindrical portion, and a coating comprising oxides and Fe is formed on the base metal surface of each of the front edge portion as well as the trunk portion by arc spraying using an iron wire.

The above described piercing-rolling mill of (III) is preferably configured such that a ratio of regions occupied by the oxides in the coating is 55% to 80%.

The above described piercing-rolling mill of (III) is preferably configured such that a ratio of regions occupied by the oxides in the coating is not more than 40% in a portion adjacent to the base metal, and 55% to 80% in a surface layer portion.

These piercing-rolling mills are preferably configured such that a thickness of the coating is larger in the front edge portion than in the trunk portion.

(IV) A method of producing a seamless tube by use of the above described piercing-rolling mill of (III), wherein while the starting material is piercing-rolled, the starting material is deformed into a hollow blank while the lubricant is being injected from the ejection hole of the plug.

Advantageous Effects of Invention

The plug of the present invention has the following remarkable effects:

(1) preventing an inner surface flaw of the hollow blank deformed by piercing-rolling;

(2) extending the life of plug; and (3) not requiring many hours for the fabrication of the plug.

The excellent features of the plug of the present invention can be fully exerted by applying the plug to the piercing machine and the method of producing a seamless tube of the present invention.

BRIEF DESCRIPTION OF DRAWINGS

FIG. 3 is a diagram to illustrate the plug disclosed in Patent Literature 4, whereas FIG. 3A is a longitudinal sectional view of the plug, and whereas

DESCRIPTION OF EMBODIMENTS

1. Construction of Piercing Machine

Figure 1:
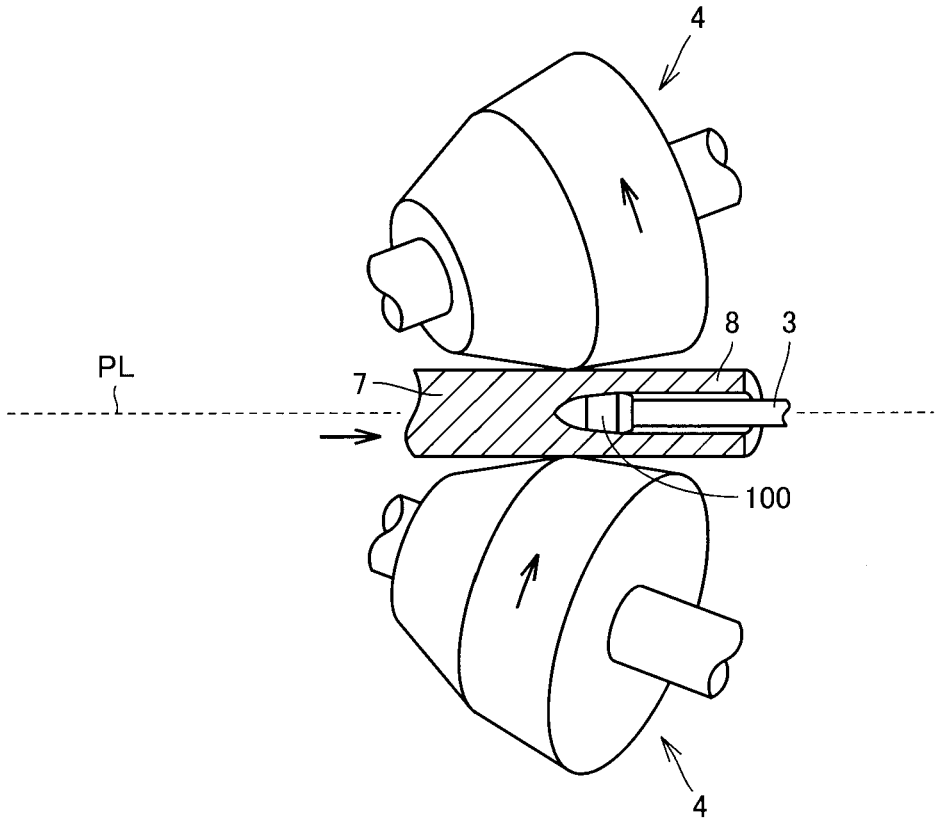
FIG. 1 is a schematic diagram to illustrate the piercing-rolling of a starting material by a conventional piercing machine.
Figure 2:
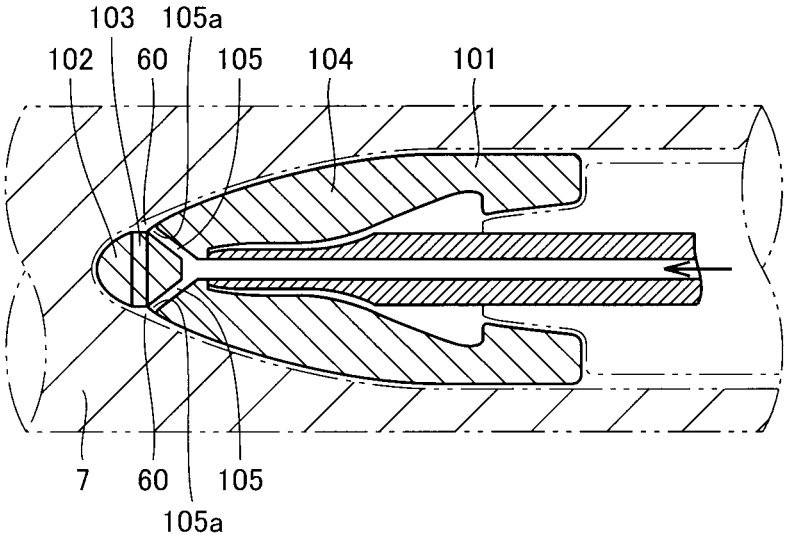
FIG. 2 is a longitudinal sectional view of the plug disclosed in Patent Literature 3.
Figure 3A:
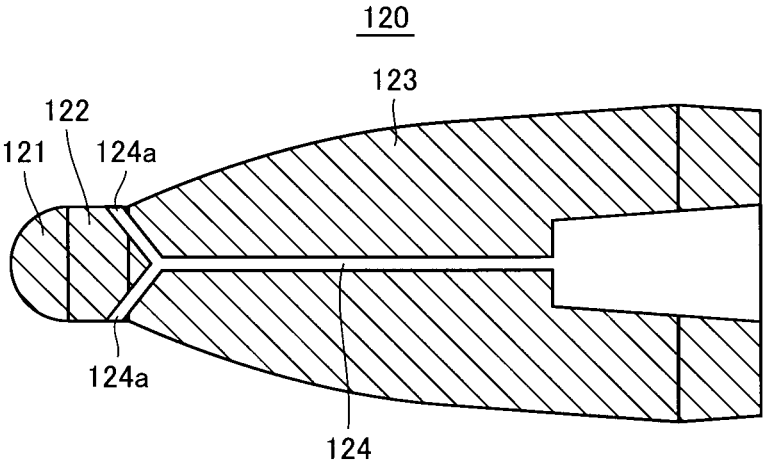
Figure 3B:
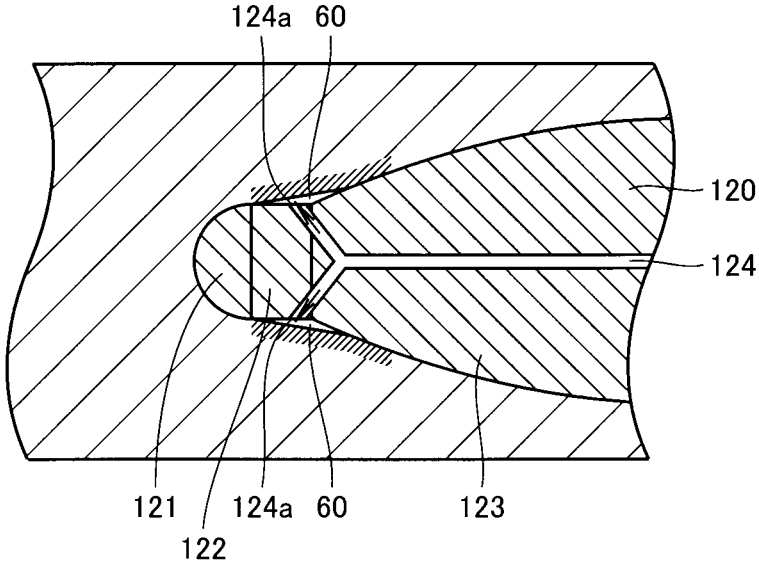
FIG. 3B is a longitudinal sectional view to illustrate how piercing-rolling undergoes.
Figure 4:
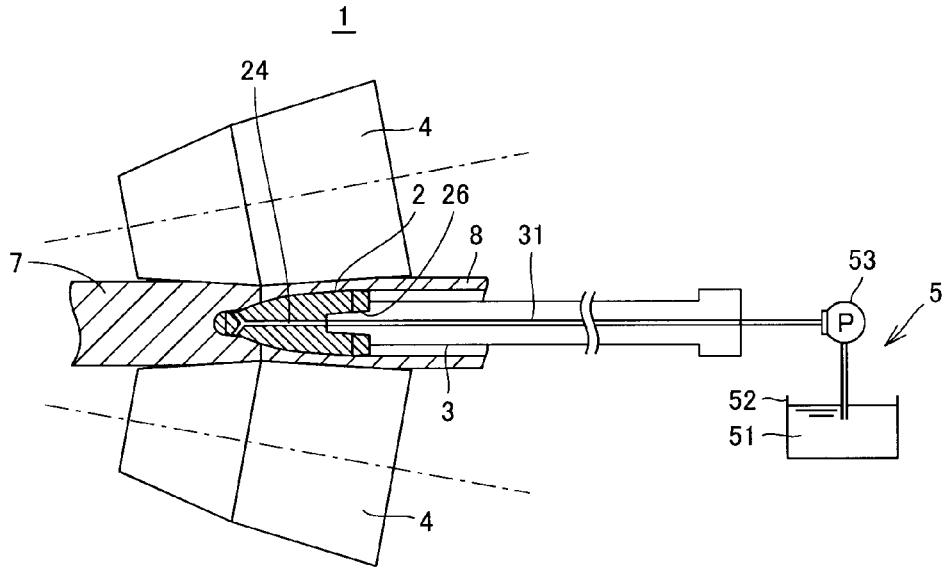
FIG. 4 is a schematic diagram to show the construction of a piercing machine of the present invention.

FIG. 4 is a schematic diagram to show the construction of a piercing machine of the present invention. As shown in the drawing, a piercing machine 1 includes a pair of conical rolls 4, a plug 2, a mandrel 3, and a lubricant supply apparatus 5.

The plug 2 has an ejection hole 24 for injecting a lubricant. The front edge of the mandrel 3 is fitted into a mandrel joint 26 provided in the rear edge of the plug 2 so that the mandrel 3 is coupled with the plug 2. Inside the mandrel 3, a through hole 31 axially running through the body from the front edge to the rear edge thereof is provided. With the mandrel 3 being coupled with the plug 2, the through hole 31 is in communication with the ejection hole 24.

The lubricant supply apparatus 5 includes a tank 52 that accommodates lubricant 51, and a pump 53. The lubricant 51 is pumped from the tank 52 to the through hole 31 by the pump 53 and is spurted from the ejection hole 24 toward the surface of the plug 2.

The conical roll 4 may have a barrel shape without being limited to a cone shape as shown in FIG. 4. Moreover, the piercing machine 1 may be of a three-roll type in which three conical rolls are provided without being limited to a two-roll type in which two conical rolls 4 are provided as shown in FIG. 4.

2. Configurations of Plug 2-1 Plug Geometry 2-1-1 First Configuration Example

Figure 5:
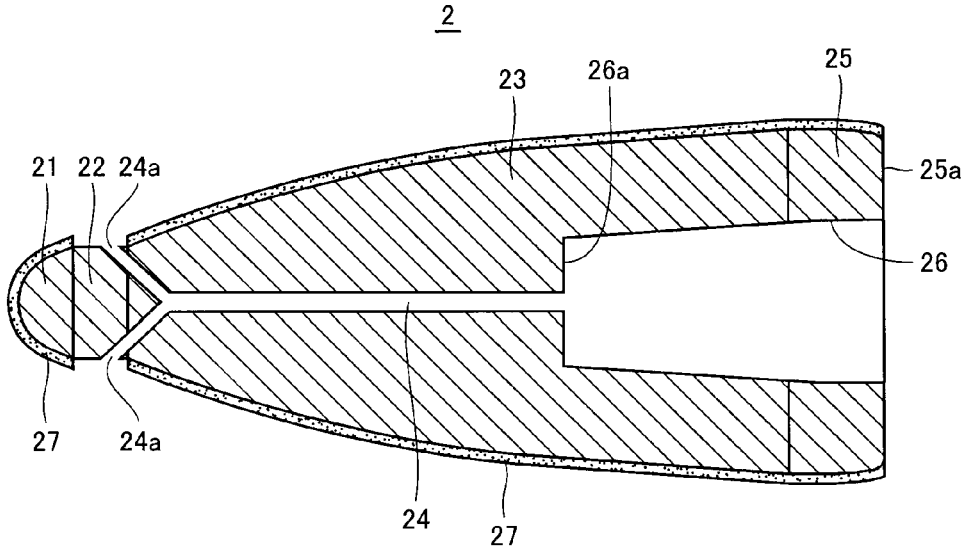
FIG. 5 is a longitudinal sectional view to show a first configuration example of the plug of the present invention.

FIG. 5 is a longitudinal sectional view to show a first configuration example of the plug of the present invention. As shown in the drawing, the plug 2 includes a front edge portion 21, a cylindrical portion 22, a trunk portion 23, and a relief portion 25.

The front edge portion 21 represents the front part of the plug 2, and has a convex curvature along an axial direction. During piercing-rolling, the front edge portion 21 is pressed against the starting material to pierce the central portion of the starting material.

The cylindrical portion 22 is provided adjacent to the front edge portion 21. During piercing-rolling, a gap is formed between the surface of the cylindrical portion 22 and the starting material, so the surface of the cylindrical portion 22 does not contact the starting material. The cylindrical portion 22 may have a frusto-conical shape whose outer diameter slightly increases toward the rear edge thereof, without being limited to a cylindrical shape having a constant outer diameter. In short, the cylindrical portion 22 can be a truly cylindrical shape or a nearly cylindrical shape whose outer diameter varies to some extent so long as contacting with the starting material is inhibited during piercing-rolling.

The trunk portion 23 is provided adjacent to the cylindrical portion 22. The trunk portion 23 has a circular cross section, and the outer diameter of which gradually increases toward the rear edge thereof. During piercing-rolling, the trunk portion 23 gradually expands the inner diameter of the starting material while being in contact with the starting material which was pierced by the front edge portion 21, and rolls the starting material between itself and the conical roll 4 to form a hollow blank having a desired wall thickness.

The relief portion 25 represents the rear portion of the plug 2, and is provided adjacent to the trunk portion 23. The outer diameter of the relief portion 25 gradually decreases toward the rear edge. During piercing-rolling, the relief portion 25 does not come into contact with the inner surface of the hollow blank formed by the trunk portion 23. Thus, the relief portion 25 serves to prevent the rear edge of the plug 2 from contacting the hollow blank and causing inner surface flaws.

The rear edge portion of the plug 2 is provided with a mandrel joint 26 for coupling the plug 2 with the mandrel 3. The mandrel joint 26 is a recess with a predetermined depth which is provided in the central portion of the rear edge surface 25*a* of the plug 2. The mandrel joint 26 is fitted with the front edge of the mandrel 3 in a well-known method to couple the plug 2 with the mandrel 3.

The plug 2 has an ejection hole 24. The ejection hole 24 runs from the bottom 26*a* of the mandrel joint 26 through the trunk portion 23 to open up on the surface of the cylindrical portion 22. The ejection hole 24 shown in FIG. 5 is configured such that a path running from the bottom 26*a* of the mandrel joint 26 through the trunk portion is divided into two branch paths and each branch path reaches the surface of the cylindrical portion 22 to form two openings 24*a* which are disposed at a circumferentially equal angle in the cylindrical portion 22. The ejection hole 24 may be configured such that the path does not branch off and forms a single opening 24*a* on the surface of the cylindrical portion 22, or otherwise such that the path is divided into three branch paths or more to form three openings 24*a* or more on the surface of the cylindrical portion 22.

When the mandrel 3 is coupled with the mandrel joint 26, the ejection hole 24 of the plug 2 communicates with the through hole 31 of the mandrel 3. The lubricant that is pumped from the lubricant supply apparatus 5 is fed to the ejection hole 21 through the through hole 31 to be injected from the opening 24*a*.

The material of the base metal of the plug 2 is the same as a well-known plug base metal (for example, a hot working tool steel specified by the JIS).

The plug 2 of the present invention, which has such an ejection hole 24 for lubricant injection, is provided with a coating 27 comprising oxides (for example, $Fe_3O_4$ and FeO) and Fe (metal) by using an arc spraying apparatus to apply arc spraying with an iron wire, which is predominantly composed of Fe, on the surface of base metal of each of the front edge portion 21 and the trunk portion 23 excluding the portion where the opening 24*a* is formed.

2-1-2 Second Configuration Example

Figure 6:
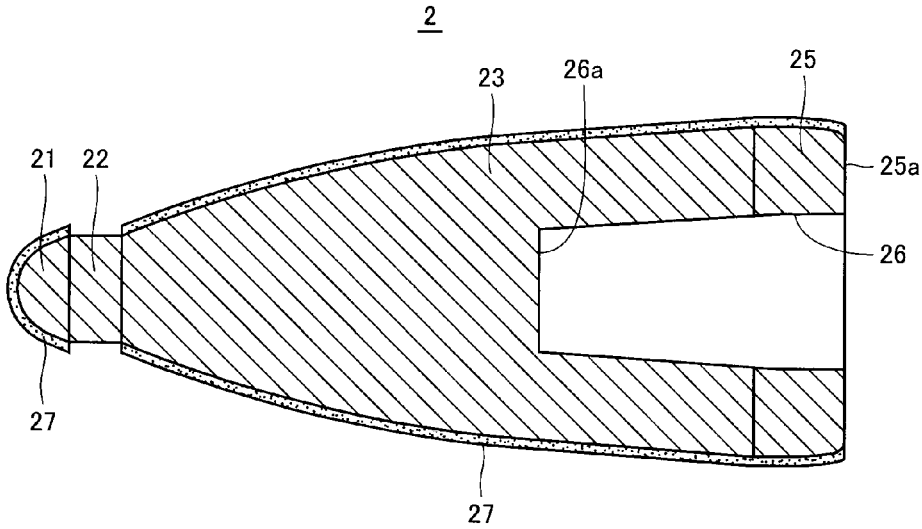
FIG. 6 is a longitudinal sectional view to show a second configuration example of the plug of the present invention.

FIG. 6 is a longitudinal sectional view to show a second configuration example of the plug of the present invention. The plug 2 shown in the drawing only differs, compared with the plug 2 of the first configuration example shown in FIG. 5 described above, in that it has no ejection hole, and thus the plug is not intended to inject lubricant.

Figure 7:
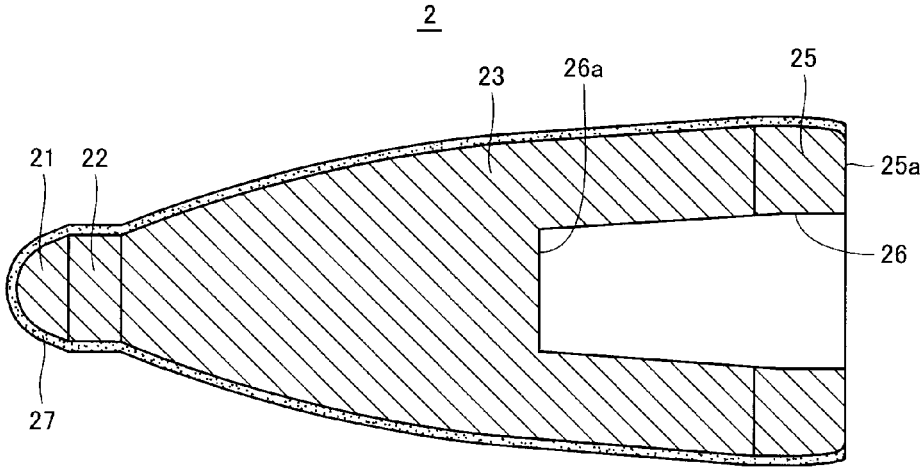
FIG. 7 is a longitudinal sectional view to show another example of the second configuration example of the plug of the present invention.

FIG. 7 is a longitudinal sectional view to show another example of the second configuration example of the plug of the present invention. The plug 2 shown in the drawing is configured, compared with the plug 2 of the second configuration example shown in FIG. 6, such that the coating 27 formed on the surface of base metal of each of the front edge portion 21 and the trunk portion 23 is formed continuously on the surface of base metal of the cylindrical portion 22 as well.

2-1-3 Third Configuration Example

Figure 8:
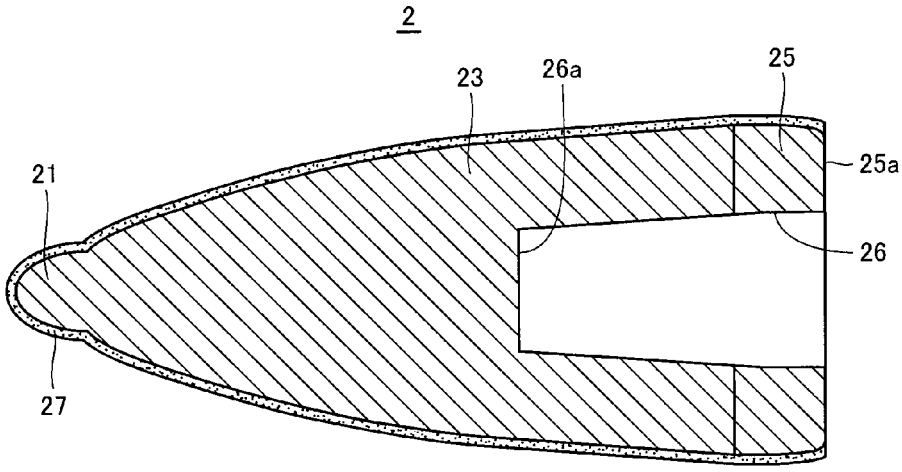
FIG. 8 is a longitudinal sectional view to show a third configuration example of the plug of the present invention.

FIG. 8 is a longitudinal sectional view to show a third configuration example of the plug of the present invention. The plug 2 shown in the drawing is a variant of the plug 2 of the second configuration example shown in FIG. 6 and FIG. 7 described above, in which the cylindrical portion 22 of the plug of the second configuration example is omitted, and the front edge portion 21 directly abuts the front edge of the trunk portion 23 and is projected therefrom.

In case of plugs 2 of the second and third configuration examples shown in FIG. 6 to FIG. 8, the piercing machine requires neither a lubricant supply apparatus nor a through hole in the mandrel.

Hereafter, characteristics of the arc sprayed coating provided in the plug of the present invention will be described.

2-2. Arc Spray Coating

Figure 9:
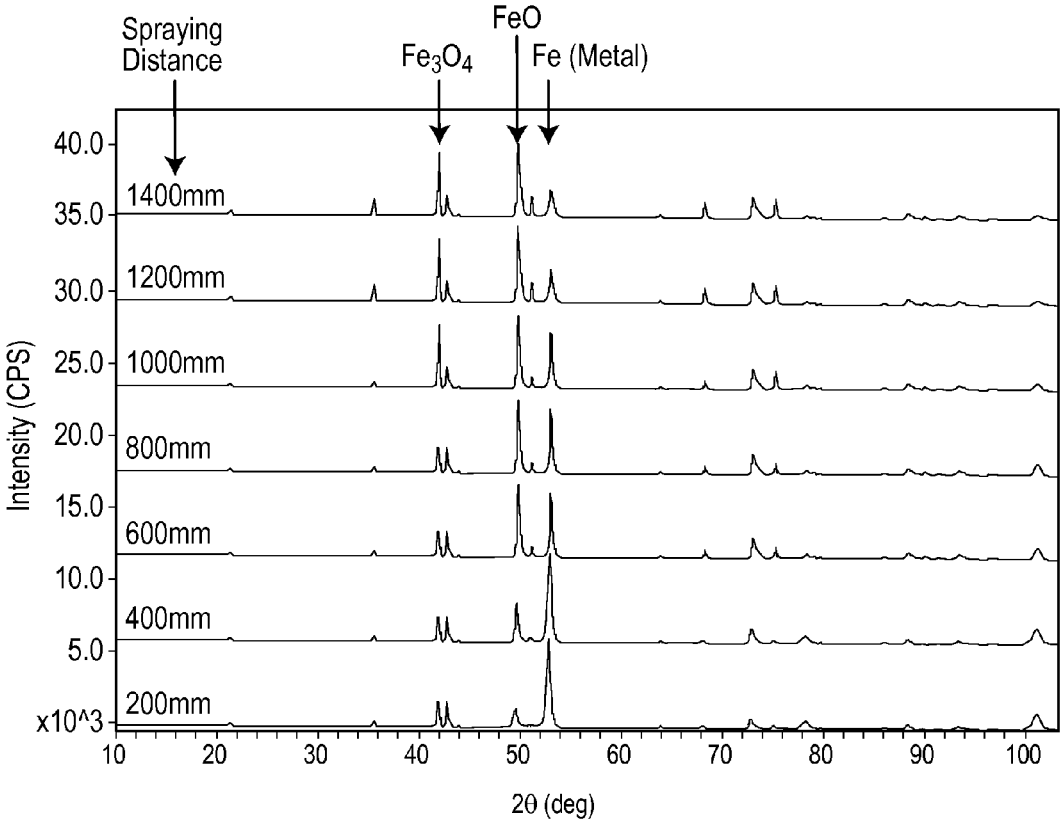
FIG. 9 is a diagram to show measurement results of X-ray analysis of surface coatings in a plug relative to arc spraying distances.
Figure 10:
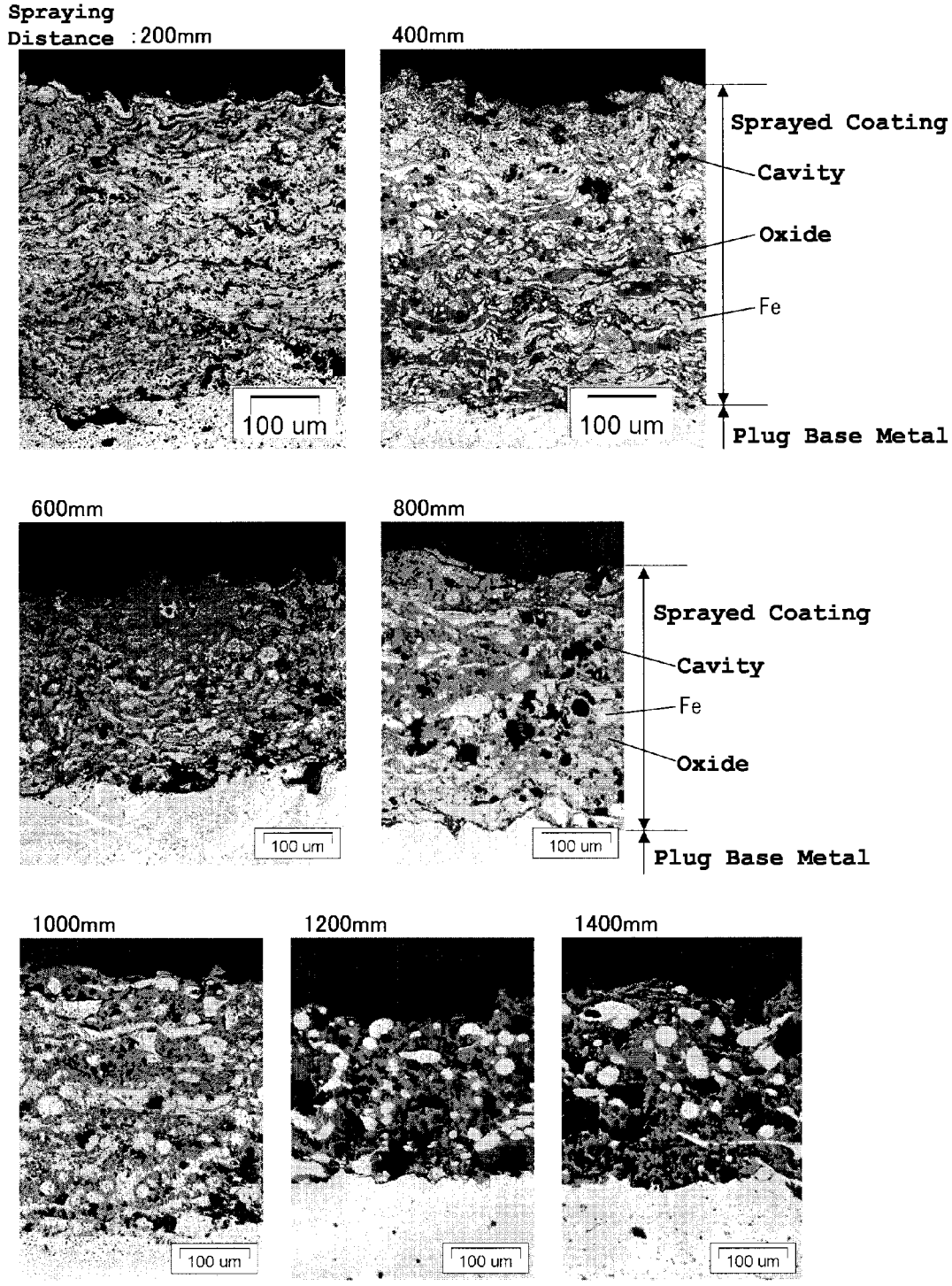
FIG. 10 is a diagram to show microstructures of cross-sections of surface coatings in a plug relative to arc spraying distances.

FIG. 9 is a diagram to show measurement results of X-ray analysis of surface coatings in a plug relative to arc spraying distances. FIG. 10 is a diagram to show microstructures of cross-sections of surface coatings in a plug relative to arc spraying distances. The spraying distance refers to the distance from the spraying nozzle of the arc spraying apparatus to the surface of the plug base metal to be sprayed. FIG. 9 and FIG. 10 respectively show the measurement results and microstructures of cross-sections of the coatings formed at respective conditions in which arc spraying was performed at each arc spraying distance varied from 200 mm, 400 mm, 600 mm, 800 mm, 1000 mm, 1200 mm, to 1400 mm.

It is evident from FIG. 9 that in the coating formed on the surface of the plug base metal by arc spraying, the contents of $Fe_3O_4$ and FeO, which are oxides, increase while the content of Fe decreases as the spraying distance increases. This is caused by the fact that the oxidation of the molten spraying metal (Fe) spurted out from a spraying nozzle proceeds much further as the spraying distance gets long.

In a cross-section of the coating shown in FIG. 10, as relevant regions in the drawing are noted, regions observed in a light gray color indicate Fe, regions observed in a dark gray color indicates oxides, and regions observed in a black color indicate cavities. As shown in the drawing, for example, when the spraying distance is 200 mm, 20% to 30% of the cross section area of the coating is occupied by oxides, and the remaining 70% to 80% of the area is occupied by Fe. When the spraying distance is 1000 mm, about 80% of the area of the coating is occupied by oxides, and the remaining approx. 20% of the area is occupied by Fe. It is also evident from the microstructure of FIG. 10 that as the spraying distance increases, the amount of oxides increases, while the amount of Fe decreases.

In this way, the ratio of the region occupied by oxides in a coating (hereafter, referred to as an "oxide ratio") varies depending on the spraying distance. Therefore, it is possible to control the oxide ratio in a coating by adjusting the spraying distance.

Figure 11:
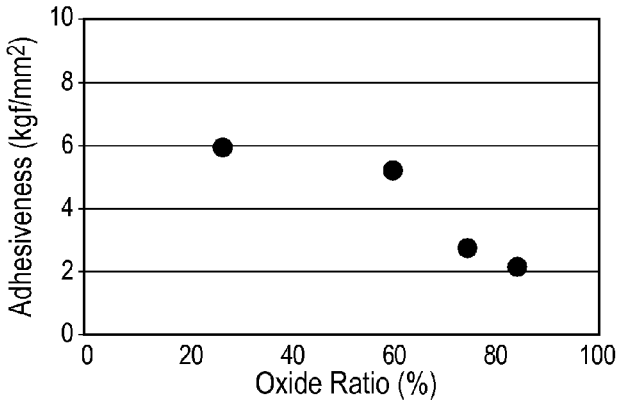
FIG. 11 is a diagram to show a correlation between the oxide ratio in the coating in a plug and the adhesiveness of the coating.

FIG. 11 is a diagram to show a correlation between the oxide ratio in the coating in a plug and the adhesiveness of the coating. The adhesiveness of the coating, which represents an adhesion performance of the coating to the surface of the plug base metal, serves as an indicator for anti-peeling property in piercing-rolling. That is, when the adhesiveness is large, the coating is less likely to peel off, and when the adhesiveness is small, the coating is more likely to peel off. As shown in the drawing, the anti-peeling property of coating declines as the oxide ratio in the coating increases, and sharply declines at an oxide ratio of not less than 80%.

Figure 12:
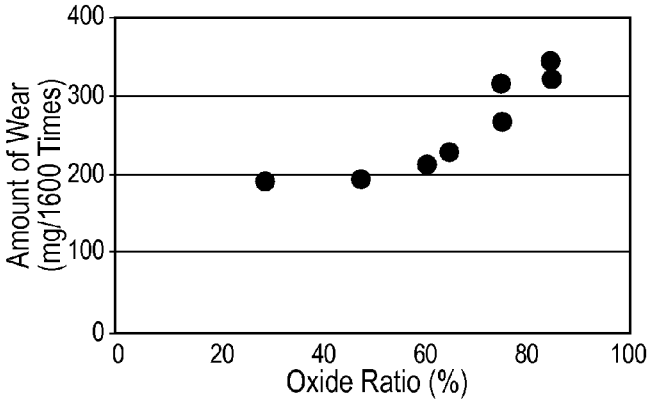
FIG. 12 is a diagram to show a correlation between the oxide ratio in the coating in a plug and the amount of wear of the coating.

FIG. 12 is a diagram to show a correlation between the oxide ratio in the coating in a plug and the amount of wear of the coating. The amount of wear of the coating, which is represented by a weight loss when the surface coating is slidingly rubbed 1600 times, serves as an indicator of wear resistance in piercing-rolling. That is, when the amount of wear is small, the coating is less likely to wear out, and when the amount of wear is large, the coating is more likely to wear out. As shown in the drawing, the wear resistance of coating declines as the oxide ratio in the coating increases, and sharply declines at an oxide ratio of not less than 80%.

The fact that the anti-peeling property and the wear resistance of a coating decline as the oxide ratio in the coating increases is caused by the decrease of Fe (metal) which lies between oxides and contributes to the bonding between the oxides.

It is evident from FIG. 11 and FIG. 12 described above that as the oxide ratio in a coating decreases, the anti-peeling property and the wear resistance of the coating are more likely to be secured. However, when the oxide ratio is too small, the heat conductivity relatively increases since most of the coating is occupied by Fe, and therefore the heat insulation performance declines. Therefore, it becomes more likely that melting loss and deformation damage occur in the front edge portion of plug during piercing-rolling.

Figure 13:
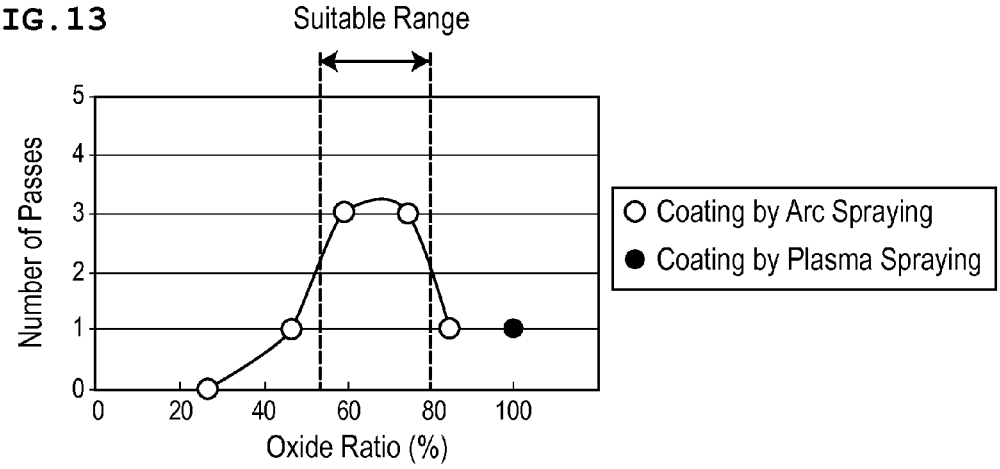
FIG. 13 is a diagram to show a correlation between the oxide ratio in the coating in a plug and the number of piercing (the number of passes) in succession.

FIG. 13 is a diagram to show a correlation between the oxide ratio in the coating in a plug and the number of piercing (the number of passes) in succession. The drawing shows the results of piercing tests to be described below.

As sample plugs, a plurality of well-known bullet-shaped plugs were prepared, which were not provided with an ejection hole for lubricant injection, being made of a hot working tool steel specified by the JIS as the base metal. A coating of about 400 μm was formed on the surface of each plug base metal by arc spraying an iron wire. When arc spraying was performed, the position of the spraying nozzle was adjusted to the spraying distance corresponding to respective oxide ratio such that the oxide ratio in the coating should become 25, 45, 60, 75, and 85%.

Note that, from the viewpoint of the adhesiveness of sprayed coating, it is desirable to carry out a preconditioning treatment on the plug surface by shotblasting before arc spraying. This is because carrying out shotblasting may provide appropriate roughness to the surface of the plug base metal thereby improving the adhesiveness between the sprayed coating and the plug base metal.

Further, for the sake of comparison, a coating was formed by plasma spraying a powder of $Fe_3O_4$ on the surface of the plug base metal by using a plasma spraying apparatus. This coating by the plasma spraying was made up of 100% oxides. The plasma spraying is inferior to the arc spraying in the following points. The apparatus to be used for plasma spraying has a complex mechanism for plasma spraying a powder and therefore requires enormous cost. The powder, which is a spray material for plasma spraying, is significantly more expensive than the iron wire which is a spray source metal for arc spraying. The plasma spraying cannot adjust the oxide ratio in the coating.

Testing that repetitively piercing-rolls a starting material was conducted by using a sample plug with a coating. As the starting material, a round billet made of SUS304 (the austenitic stainless steel specified by the JIS) and with an outer diameter of 70 mm and a length of 1000 mm was used. This starting material was heated to 1200° C. and a piercing testing to deform the same into a hollow blank of an outer diameter of 74 mm, a wall thickness of 8.6 mm, and a length of 2200 mm was conducted.

Under that condition, visual inspection was performed for a sample plug every time when piercing-rolling was completed, and the life of plug was evaluated by investigating the number of passes at the time when melting loss or deformation damage was discerned in the front edge portion of plug, that is, the number of starting materials that were able to be piercing-rolled successively (the number of piercing-rolling in succession).

As shown by hollow circles in FIG. 13, the number of piercing-rolling in succession was 0 (zero) in the plug in which the oxide ratio in the coating was 25%, the number of piercing-rolling in succession was 1 pass in the plugs in which the oxide ratios in the coating were 45% and 85%, and the number of piercing-rolling in succession was 3 passes in the plugs in which the oxide ratios in the coating were 60% and 75%.

In the plasma sprayed plug for comparison, as shown by a solid black circle in FIG. 13, the number of piercing-rolling in succession was 1 pass. Moreover, in the plugs in which the oxide ratios in the coating were 25% and 45%, melting loss and deformation damage were observed in the front edge portion of plug.

The results shown in FIG. 13 revealed that the plugs with an arc sprayed coating in which the oxide ratio in the coating was adjusted to be 55% to 80% had a life of not less than 2 times that of the plasma sprayed plug, and further the plugs with an arc sprayed coating in which the oxide ratio in the coating was adjusted to be 60% to 75% had a life of not less than 3 times that of the plasma sprayed plug.

Such characteristics of the arc sprayed coating will be similarly exerted even when arc welding is applied to the above described plug of the first configuration example of the present invention which has an ejection hole, and the plugs of the second and third configuration examples of the present invention which have no ejection hole. In such cases, the plugs 2 of the first, second, and third configuration examples of the present invention shown in FIG. 5 to FIG. 8 described above will have a longer life than that of a plasma sprayed plug if the coating 27 is formed on the surface of base metal of each of the front edge portion 21 and the trunk portion 23 (also including the cylindrical portion 22 in the plug of the second configuration example) by arc spraying such that the oxide ratio in the coating 27 is 55% to 80%. Further, in the viewpoint of further extending the life of plug, it is preferable to configure the oxide ratio in the coating 27 to be 60% to 75%.

When the coating by arc spraying is not formed in the cylindrical portion 22, the plug 2 of the present invention can be easily obtained by masking the surface of the cylindrical portion 22 with an adhesive tape, etc.

Next, further effectiveness relating to the oxide ratio in the coating, which has been revealed from the results shown in FIG. 13 described above, will be discussed. The plug which was used in the test that led to the results shown in FIG. 13 described above is the one provided with a coating in which the oxide ratio in the coating is uniform throughout the entire region encompassing the portion adjacent to the base metal and the surface layer portion by performing arc spraying with the spraying distance being kept constant. Here, a test was conducted on a plug in which the oxide ratio in the coating gradually increases toward the surface layer side.

When forming a coating, arc spraying is started in a state where the spraying nozzle was placed near the surface of the plug base metal, that is, in a state where the spraying distance was short, and thereafter the spraying nozzle was moved away to complete the arc spraying in a state where the spraying distance became sufficiently long. As a result, a coating in which the oxide ratio gradually increases toward the surface layer side was formed on the surface of the plug base metal. This coating had a lower oxide ratio in the portion adjacent to the base metal and a higher oxide ratio in the surface layer portion.

Figure 14:
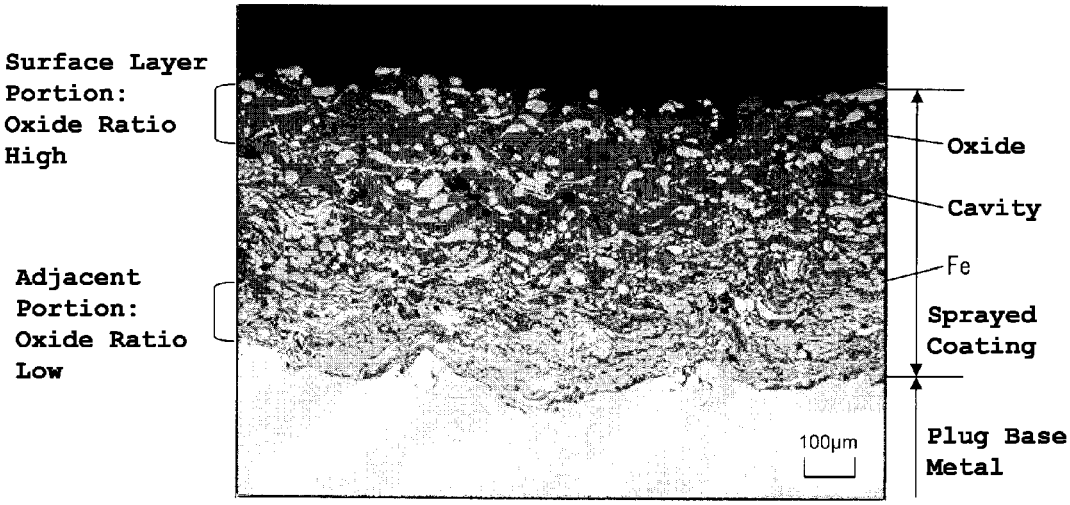
FIG. 14 is a diagram to show a microstructure of the cross-section of the surface coating in a plug when arc spray is conducted while gradually increasing the spraying distance.

FIG. 14 is a diagram to show a microstructure of the cross-section of the surface coating in a plug when arc spray is conducted while gradually increasing the spraying distance. In the cross-section of the coating shown in the drawing, as with FIG. 10 described above, regions observed in a light gray color indicate Fe, regions observed in a dark gray color indicate oxides, and regions observed in a black color indicate cavities. As shown in FIG. 14, the coating formed on the surface of the plug base metal had a lower oxide ratio in the portion adjacent to the base metal and a higher oxide ratio in the surface layer portion.

Testing similar to the above described piercing testing was conducted by using such sample plugs in which the oxide ratio in the coating was varied. The evaluation thereof was performed in terms of the life of plug based on the above described number of piercing (the number of passes) in succession. Moreover, for the sake of comparison, a similar test was conducted on a plug with a coating, in which the oxide ratio was uniform over the entire affected area, formed on the surface of the plug base metal by arc spraying with the spraying distance being kept constant. Table 1 shows the test results.

TABLE 1

| Test No. | Arc spraying condition Spraying distance | Number of piercing in succession |
|---|---|---|
| 1 | Constant at 1000 mm | 2 passes |
| 2 | Varied from 200 mm to 1000 mm | 4 passes |
| 3 | Varied from 400 mm to 1000 mm | 3 passes |
| 4 | Varied from 500 mm to 1000 mm | 2 passes |

As shown in the table, the plug of Test No. 1 is the one on which the coating was formed by arc spraying with the spraying distance being kept constant at 1000 mm, and the oxide ratio in the coating was uniform around 80% over the entire affected area.

The plug of Test No. 2 is the one on which a coating was formed by arc spraying with the spraying distance being gradually varied from 200 mm to 1000 mm; the plug of Test No. 3 is the one on which a coating was formed by arc spraying with the spraying distance being gradually varied from 400 mm to 1000 mm, and the plug of Test No. 4 is the one on which a coating was formed by arc spraying with the spraying distance being gradually varied from 500 mm to 1000 mm. As a result, in the plug of Test No. 2, the oxide ratio in the coating was about 25% in the portion adjacent to the base metal and about 80% in the surface layer portion; in the plug of Test No. 3, the oxide ratio in the coating was about 40% in the portion adjacent to the base metal and about 80% in the surface layer portion; and in the plug of Test No. 4, the oxide ratio in the coating was about 50% in the portion adjacent to the base metal and about 80% in the surface layer portion.

In any of the plugs of Test Nos. 1 to 4, the thickness of the coating was about 400 μm.

As shown in Table 1, the plug of Test No. 1, in which the oxide ratio in the coating was uniform, exhibited 2 passes in the number of piercing in succession. While, among the plugs of Test Nos. 2 to 4 in which the oxide ratio in the coating is higher in the surface layer side than in the base metal side, the plug of Test No. 2 exhibited 4 passes in the number of piercing in succession, the plug of Test No. 3 exhibited 3 passes in the number of piercing in succession, wherein all these Test Nos. increased in the number of piercing in succession, comparing with that of Test No. 1. And the plug of Test No. 4 exhibited 2 passes in the number of successive piercing, thus showing comparable numbers of piercing in succession as with the plug of Test No. 1.

The results shown in Table 1 revealed that a plug in which the oxide ratio in the coating was higher in the surface layer side than in the base metal side had a life of plug equal to or longer than that of a plug in which the oxide ratio in the coating was uniform, and further that a plug in which the oxide ratio in the coating was not more than 40% in the portion adjacent to the base metal exhibited an extension in the life of plug. This is caused by the fact that when the oxide ratio was low in the portion adjacent to the plug base metal in the coating, Fe (metal) became rich and therefore the adhesion between the coating and the plug base metal was strengthened, thus relieving the stress applied thereto and making the coating less likely to peel off.

These properties of the arc sprayed coating in which the oxide ratio was varied will be similarly exerted when arc spraying is applied to the plug of the first configuration example of the present invention which has the above described ejection hole, and the plugs of the second and third configuration examples of the present invention which have no ejection hole. In such cases, it is preferable to configure such that the oxide ratio in the coating is higher in the surface layer side than in the base metal side, in particular, such that the oxide ratio is not more than 40% in the portion adjacent to the base metal and the oxide ratio is about 55% to 80% in the surface layer portion.

Next, the thickness of the coating to be formed on the surface of the plug base metal will be discussed. The above described sample plugs have a bullet-shaped exterior and are provided with a coating of uniform thickness over the entire region from the truck portion to the front edge portion of the plug. Here, in order to exhibit the effects of coating thickness in the trunk portion and the front edge portion, the coating thickness of each of the trunk portion of plug and the front edge portion of plug is varied widely. Testing similar to the above described piercing testing was conducted using the sample plugs in which the coating thickness was varied. The evaluation thereof was conducted in terms of the life of plug based on the number of piercing (the number of passes) in succession as described above, similar to the evaluation shown in the foregoing Table 1. Table 2 shows the testing results.

TABLE 2

| Test | Coating thickness | | Number of piercing |
|---|---|---|---|
| No. | Trunk portion | Front edge portion | in succession |
| 11 | 400 μm | 400 μm | 4 passes |
| 12 | 400 μm | 600 μm | 5 passes |
| 13 | 400 μm | 800 μm | 6 passes |
| 14 | 600 μm | 800 μm | 6 passes |
| 15 | 800 μm | 800 μm | 1 pass |
| 16 | 400 μm | 1200 μm | 10 passes |

As shown in the same Table, the plug of Test No. 11 was the one which was provided with a coating having a thickness of about 400 μm over the entire region from the trunk portion to the front edge portion. The plug of Test No. 12 was the one provided with a coating having a thickness of about 400 μm in the trunk portion and about 600 μm in the front edge portion; the plug of Test No. 13 was the one provided with a coating having a thickness of about 400 μm in the trunk portion and about 800 μm in the front edge portion; and the plug of Test No. 14 was the one provided with a coating having a thickness of about 600 μm in the trunk portion and of about 800 μm in the front edge portion. The plug of Test No. 15 was the one provided with a coating having a thickness of about 800 μm over the entire region. The plug of Test No. 16 was the one provided with a coating having a thickness of about 400 μm in the trunk portion as with Test Nos. 11 to 13, and a thickness of about 1200 μm, which was larger than in any other plugs, in the front edge portion.

Moreover, any of the plugs of Test Nos. 11 to 16 was the one provided with a coating by being subjected to arc spraying with the spraying distance being gradually varied from 200 mm to 1000 mm, and the oxide ratio in the coating was higher in the surface layer side than in the base metal side.

As shown in Table 2, the plug of Test No. 11, in which the coating thickness was thin and uniform over the entire region, exhibited 4 passes in the number of piercing in succession. The plugs of Test Nos. 12, 13, 14, and 16, in which the coating thickness was larger in the front edge portion than in the trunk portion, exhibited 5, 6, 6, and 10 passes respectively in the number of piercing in succession, and the number of piercing in succession increased as the coating thickness of the front edge portion of plug increased. In the plug of Test No. 15, in which the coating thickness was large and uniform over the entire region, the coating of the trunk portion of plug peeled off after one pass of piercing, and the number of piercing in succession remained to be a single pass.

The results shown in Table 2 clearly show that the life of plug extends as the coating thickness in the front edge portion of plug increases. Also when the coating thickness in the trunk portion of plug is excessively large, peeling off of the coating will occur during piercing thus deteriorating the life of plug.

Such properties relating to the coating thickness of arc spraying will also be exerted in a similar fashion when arc spraying is applied to the plug of the first configuration example of the present invention which has the ejection hole described above, and the plugs of the second and third configuration examples which have no ejection hole.

Figure 15:
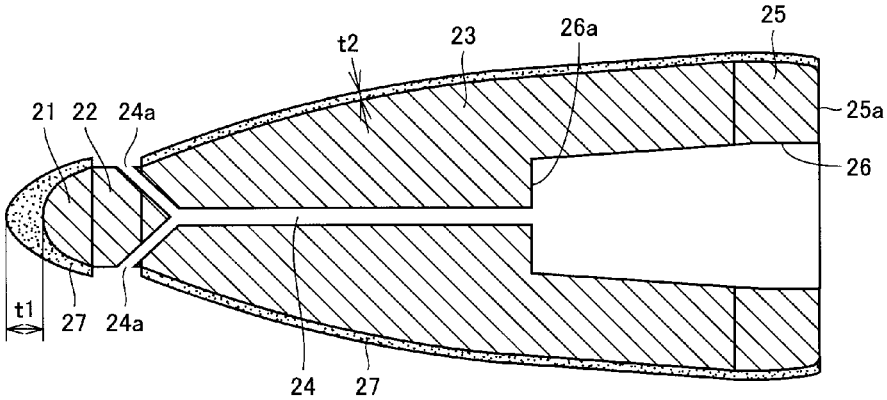
FIG. 15 is a longitudinal sectional view to show another example of the first configuration example of the plug of the present invention.

FIG. 15 is a longitudinal sectional view to show another example of the first configuration example of the plug of the present invention. The plug 2 of the present invention shown in the drawing is the one on which the coating 27 of the front edge portion 21 having the thickness t1 was formed by arc spraying so that the thickness t1 is larger than the thickness t2 of the coating 27 of the trunk portion 23 based on the result shown in Table 2 described above. This plug 2 is extremely effective in preventing the wear and melting loss of the front edge portion 21. This is because the front edge portion 21 of plug tends to run short of the supply of lubricant, thereby resulting in the occurrence of wear and melting loss even if lubricant is injected from the ejection hole 24 during piercing.

Figure 16:
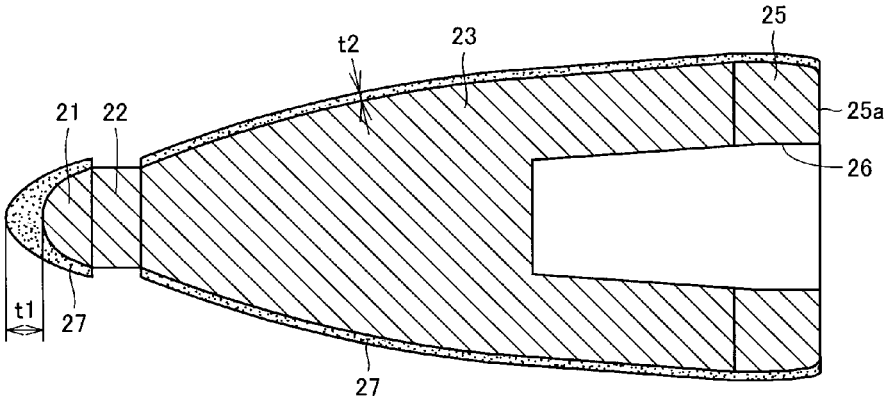
FIG. 16 is a longitudinal sectional view to show another example of the second configuration example of the plug of the present invention.

FIG. 16 is a longitudinal sectional view to show another example of the second configuration example of the plug of the present invention. The plug 2 of the present invention shown in the drawing is configured, as with the plug 2 of the first configuration example shown in FIG. 15, such that in order to prevent the wear and melting loss of the front edge portion 21, the coating is formed by arc spraying such that the thickness t1 of the coating 27 of the front edge portion 21 is larger than the thickness t2 of the coating 27 of the trunk portion 23.

The plug 2 of the first and second configuration examples shown in FIG. 15 and FIG. 16 is preferably configured such that the coating thickness t2 of the trunk portion 23 of the plug is less than 800 μm, and more preferably not more than 600 μm based on the result shown in Table 2 described above. Similarly, it is preferable, for the plug of the third configuration example as well, that the coating thicknesses of the front edge portion and the trunk portion are specified.

3. Production Method of Seamless Tubes

A starting material (round billet) is charged into a well-known heating furnace and heated. The heated starting material is discharged from the heating furnace. Next, the piercing machine 1 shown in FIG. 4 is used to piercing-roll the discharged starting material 7 to yield a hollow blank 8. When doing so, if the plug 2 of the first configuration example is used, lubricant 51 is pumped by the lubricant supply apparatus 5, while the starting material 7 being piercing-rolled, thus causing the lubricant to be injected from the ejection hole 24 of the plug 2.

The lubricant 51 is injected while the starting material 7 being piercing-rolled, but not when the starting material 7 is not subjected to the piercing-rolling. The piercing machine 1 includes a load sensor not shown for detecting a load applied to the conical roll 4. The lubricant 51 is pumped by the lubricant supply apparatus 5 in corresponding to a load signal which is outputted by the load sensor upon detecting the load. This allows the lubricant 51 to be injected only during piercing-rolling. Other sensor may be used in place of the load sensor to determine whether or not piercing-rolling is under way.

After the starting material 7 is piercing-rolled by the piercing machine 1 and is formed into a hollow blank 8, the hollow blank 8 is elongation-rolled by a elongation-rolling mill (for example, a plug mill and a mandrel mill). After the elongation rolling, the shape is adjusted by a sizing mill (for example, a stretch reducer, a reeler, and a sizer) to yield a seamless tube.

Figure 17:
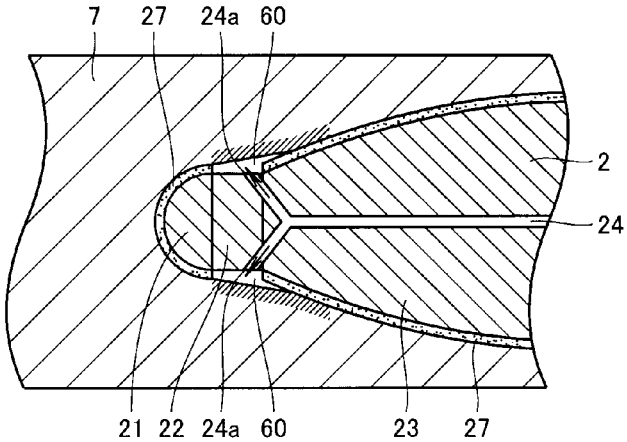
FIG. 17 is a longitudinal sectional view to show how the piercing-rolling undergoes using the plug of the first configuration example of the present invention.

FIG. 17 is a longitudinal sectional view to show how the piercing-rolling undergoes using the plug of the first configuration example of the present invention. As shown in the drawing, during piercing-rolling, after contacting the front edge portion 21 of the plug 2, the starting material 7 contacts the surface of the rear part of the trunk portion 23 without contacting surfaces of the cylindrical portion 22 and the front part of the trunk portion 23. That is, a gap 60 is formed between the starting material 7 and the surface of the cylindrical portion 22. Under that condition, since the opening 24*a* of the ejection hole 24 is formed on the surface of the cylindrical portion 22, the lubricant is injected from the opening 24*a* into the gap 60. Therefore, a high pressure is not required for injecting lubricant.

Owing to the above described gap 60, the opening 24*a* of the ejection hole 24 does not contact the starting material 7. Therefore, it is possible to prevent the occurrence of inner surface flaws to be caused by the contact between the starting material 7 and the opening 24*a*. Moreover, it is possible to prevent the opening 24*a* from undergoing melting loss and being clogged due to the contact with the starting material 7.

Since the opening 24*a* of the ejection hole 24 is not formed in the front edge portion 21 as well as in the trunk portion 23, either of which is to contact the starting material 7, the temperature rise of the opening 24*a* during piercing is suppressed. Therefore, even when a glass-based lubricant is used, the lubricant is not likely to solidify in the vicinity of the opening 24*a* so that the ejection hole 24 will not be clogged by the solidified lubricant.

In the front edge portion 21 and the trunk portion 23, any of which is to contact the starting material 7 during piercing-rolling, a coating 27 is formed on the surface of the base metal thereof by arc spraying, respectively. Since the coating 27 comprises oxides and Fe, it has an excellent heat insulation performance and an anti-seizing property. Therefore, the coating 27 can prevent the front edge portion 21 and the trunk portion 23 of the plug 2 from undergoing wear and melting loss.

The coating 27 is not formed in the cylindrical portion 22 in which the opening 24*a* of the ejection hole 24 is formed. For this reason, there will be no chance that the opening 24*a* is narrowed or blocked by the coating, and thus smooth injection of the lubricant is not impaired. Even if the coating is not formed on the surface of base metal of the cylindrical portion 22, since the starting material 7 will not come into contact with the surface of the cylindrical portion 22, the wear and melting loss of the cylindrical portion 22 do not occur.

Further, since the formation of the coating 27 is conducted by arc spraying, processing for many hours such as a conventional heat treatment for forming a scale coating. is not required Therefore, it does not require a long time to make the plug 2 in which the coating 27 is formed by arc spraying.

As described so far, it is possible to prevent the opening 24*a* from clogging in any event that is caused by the contact with the starting material 7, or otherwise by the solidification of lubricant, and also possible to inhibit the wear and the melting loss of any of the front edge portion 21 and the trunk portion 23, thus enabling the extension of the life of plug.

EXAMPLES

Example 1

In order to confirm the effects of the present invention, a piercing testing was conducted by using the piercing machine shown in FIG. 4 described above. The conditions of the testing were as follows.

[Testing Method]

(1) Workpiece (Starting Material)

Dimensions: a round billet of an outer diameter of 70 mm and a length of 1000 mm.

Material: SUS304 specified by the JIS Standard.

(2) Plug

Figure 18:
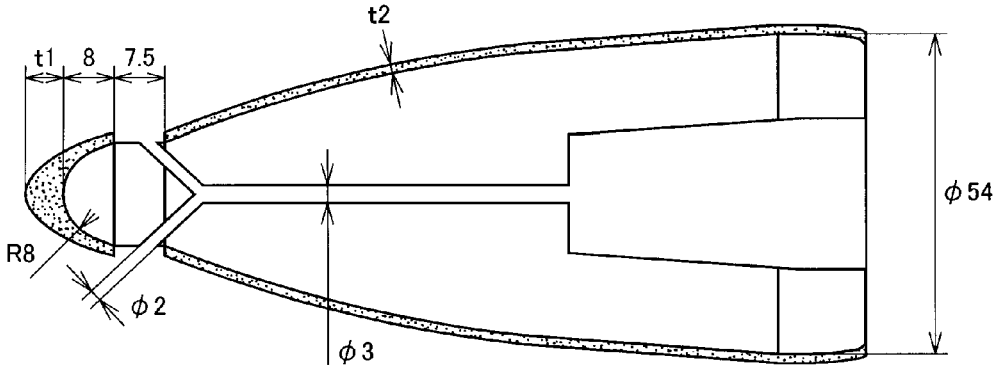
FIG. 18 is a longitudinal sectional view of the plug used in Example 1.

A plug corresponding to the above described first configuration example and having an ejection hole was adopted. A hot working tool steel specified by the JIS Standard was used as the base metal and a coating was formed on the surface of the base metal by arc spraying using an iron wire such that the respective coating thickness of the front edge portion as well as the trunk portion was widely varied. The geometry of the plug was as shown in FIG. 18, and the coating thickness t1 of the front edge portion and the coating thickness t2 of the trunk portion were as shown in Table 3. Numbers shown in FIG. 18 is designated by mm as a unit of dimension.

TABLE 3

| Plug No. | Arc spraying condition Spraying distance | Coating thickness Front edge portion t1 | Coating thickness Trunk portion t2 | Number of piercing in succession | State of ejection hole |
|---|---|---|---|---|---|
| A | Constant at 1000 mm | 400 μm | 400 μm | 3 passes | ○ |
| B | Varied from 200 mm to 1000 mm | 400 μm | 400 μm | 4 passes | ○ |
| C | Varied from 200 mm to 1000 mm | 800 μm | 400 μm | 6 passes | ○ |
| D | Varied from 200 mm to 1000 mm | 1200 μm | 400 μm | 10 passes | ○ |
| E | Varied from 200 mm to 1000 mm | 800 μm | 800 μm | 2 passes | ○ |
| F | Varied from 200 mm to 1000 mm | 1200 μm | 300 μm | 10 passes | ○ |

TABLE 3-continued

| Plug No. | Arc spraying condition Spraying distance | Coating thickness Front edge portion t1 | Coating thickness Trunk portion t2 | Number of piercing in succession | State of ejection hole |
|---|---|---|---|---|---|
| G | Varied from 200 mm to 1000 mm | 1200 μm | 200 μm | 6 passes | Δ |
| H | Scale coating by heat treatment | 400 μm | 400 μm | 2 passes | X |

When forming the coating, two categories were adopted: one in which the spraying distance was fixed at 1000 mm, and the other in which the spraying distance was gradually varied from 200 mm to 1000 mm. In the former category, the oxide ratio in the coating was about 80% uniformly over the entire relevant region; and in the latter category, the oxide ratio in the coating was about 25% in the portion adjacent to the base metal and about 80% in the surface layer portion.

Moreover, for the sake of comparison, a plug in which a scale coating was formed over the entire area of the surface of base metal was prepared by heat treatment.

(3) Piercing-Rolling

The above described respective plugs were used to repetitively piercing-roll the workpieces, which were heated to 1200° C., to produce hollow shells of the following dimensions.

Hollow shell dimensions: an outer diameter of 74 mm, a wall thickness of 8.6 mm, and a length of 2200 mm.

While piercing-rolling was conducted, a glass-based lubricant having the chemical composition shown in Table 4 was injected from the plug.

TABLE 4

| Component | Content (% by mass) |
|---|---|
| Oxide-base layered substance | 10~40 |
| One or more kinds of alkali metal salts or amine salts of boric acid | 5~30 |
| One or more kinds of water-soluble polymers | 0.11~3.0 |
| Water | Balance |

[Evaluation Method]

(1) Life of Plug

Visual inspection was made for a plug at every time when piercing-rolling was completed, and the life of plug was evaluated by the number of passes at a time when melting loss or deformation damages occurred in the front edge portion of plug, that is, the number of the starting materials that were able to be piercing-rolled successively (the number of piercing-rolling in succession).

Moreover, the life of plug was evaluated by urging lubricant to be injected from the ejection hole of the plug at every time when piercing-rolling was completed and observing the state of the injection of the lubricant.

Reference symbols in the "state of ejection hole" column of Table 3 have the following meanings.

○: Good, indicating that no problem was perceived in the injection of lubricant.

Δ: Fair, indicating that although the injection of lubricant was seemingly possible, the throughput of injection decreased and deterioration thereof was perceived.

x: Unacceptable, indicating that the injection of lubricant was disabled.

(2) Inner Surface Flaws

Inner surface flaws were evaluated by the presence or absence of a flaw(s) by visually inspecting the inner surface of each hollow shell that had been formed by piercing-rolling.

[Testing Results]

The results shown in Table 3 indicate the followings.

The plug H, which was a Comparative Example and in which a scale coating was formed by heat treatment, exhibited 2 passes in the number of piercing in succession, and melting loss was observed in the front edge portion of plug. The ejection hole of the plug H was clogged after the 2 passes, and the injection of lubricant was disabled. This was caused by the fact that when the plug was heat-treated, a scale grew in the ejection hole as well and the ejection hole was facilitated to be easily clogged before the piercing.

The plugs A to G were Inventive Examples of the present invention and each has a coating formed by arc spraying in the front edge portion as well as in the trunk portion, wherein each exhibited a good state of the ejection hole. Among those, however, the plug G, in which the coating thickness of the trunk portion was as thin as 200 μm, exhibited a decline in the throughput of the injection of lubricant. The conceivable reason for this is that the heat insulation performance in the trunk portion declined because of the thin coating thickness of the trunk portion, and thereby the opening of the ejection hole gradually deformed as the piercing was repeated.

The plug A, which was an Inventive Example of the present invention, was configured such that the spraying distance was fixed at 1000 mm, and the coating thickness was 400 μm both in the front edge portion and the trunk portion. This plug A exhibited 3 passes in the number of piercing in succession and a longer life than that of the plug H which was a Comparative Example.

Each of the plugs B to G, Inventive Examples of the present invention, has the oxide ratio in the coating configured to be higher in the surface layer portion than in the base metal side by varying the spraying distance, exhibited a life equal to or longer than that of the plug H which was a Comparative Example.

Among those, the plug B, in which the coating thickness was 400 μm both in the front edge portion and the trunk portion, exhibited 4 passes in the number of piercing in succession. Moreover, the plugs C and D, in which the coating thickness of the front edge portion was increased to 800 μm and 1200 μm respectively, exhibited an increase in the number of piercing in succession to be 6 passes and 10 passes, respectively.

The plug E, in which the coating thickness was configured to be 800 μm both in the front edge portion and the trunk portion, exhibited a peeling off in the coating of the trunk portion and was disabled after 2 passes of piercing. This was caused by the fact that the coating thickness of the trunk portion was too large so that the coating was facilitated to be readily peeled off.

Each of the plugs F and G is configured such that the coating thickness of the front edge portion was 1200 μm and the coating thickness of the trunk portion was configured to be respectively 300 μm and 200 μm, that is, to be less than 400 μm, exhibited 10 passes and 6 passes in the number of piercing in succession, respectively.

Moreover, in any of the plugs A to H, any inner surface flaw was not observed in the obtained hollow shells.

Example 2

A piercing testing was conducted by adopting a plug having no ejection hole. The conditions of the testing were as follows.

[Testing Method]

(1) Workpiece (Starting Material)

Dimensions: a round billet of an outer diameter of 70 mm and a length of 1000 mm.

Material: SUS304 specified by the JIS Standard.

(2) Plug

Figure 19:
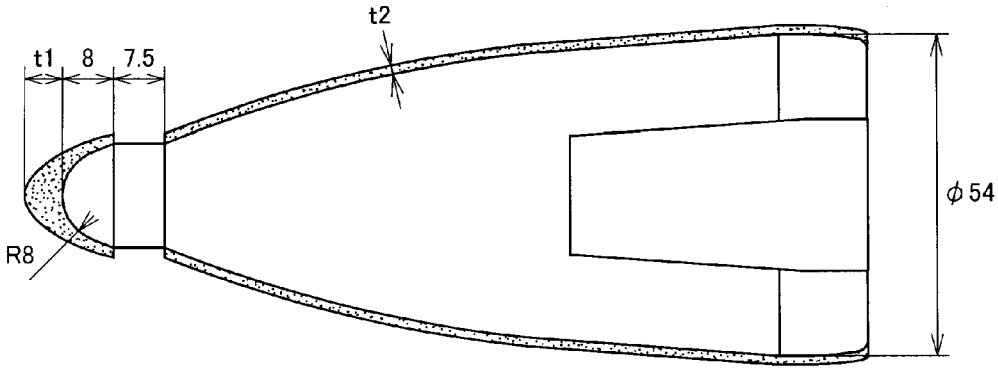
FIG. 19 is a longitudinal sectional view of the plug used in Example 2.

A plug corresponding to the above described second configuration example and having no ejection hole was adopted. A hot working tool steel specified by the JIS Standard was used as the base metal and a coating was formed on the surface of the base metal by arc spraying using an iron wire such that the coating thickness of each of the front edge portion and the trunk portion was widely varied. The geometry of the plug was as shown in FIG. 19, and the coating thickness t1 of the front edge portion and the coating thickness t2 of the trunk portion were as shown in Table 5. Numbers shown in FIG. 19 are designated by mm as a unit of dimension.

TABLE 5

| Plug No. | Arc spraying condition Spraying distance | Coating thickness Front edge portion t1 | Coating thickness Trunk portion t2 | Number of piercing in succession |
|---|---|---|---|---|
| AA | Constant at 1000 mm | 400 μm | 400 μm | 2 passes |
| BB | Varied from 200 mm to 1000 mm | 400 μm | 400 μm | 3 passes |
| CC | Varied from 200 mm to 1000 mm | 800 μm | 400 μm | 5 passes |
| DD | Varied from 200 mm to 1000 mm | 1200 μm | 400 μm | 9 passes |
| EE | Varied from 200 mm to 1000 mm | 800 μm | 800 μm | 1 pass |
| FF | Varied from 200 mm to 1000 mm | 1200 μm | 300 μm | 9 passes |
| GG | Varied from 200 mm to 1000 mm | 1200 μm | 200 μm | 5 passes |
| HH | Scale coating by heat treatment | 400 μm | 400 μm | 1 pass |

When forming the coating, two categories were adopted: one in which the spraying distance was fixed at 1000 mm, and the other in which the spraying distance was gradually varied from 200 mm to 1000 mm. In the former category, the oxide ratio in the coating was about 80% uniformly over the entire relevant region; and in the latter case, the oxide ratio in the coating was about 25% in the portion adjacent to the base metal and about 80% in the surface layer portion.

Moreover, for the sake of comparison, a plug in which a scale coating was formed over the entire area of the surface of base metal was prepared by heat treatment. Before every piercing-rolling, a glass-based lubricant having a chemical composition shown in Table 4 described above was applied and stacked on the surface of coating of each plug.

(3) Piercing-Rolling

The above described respective plugs were used to repetitively piercing-roll workpieces, which were heated to 1200° C., to produce hollow shells of the following dimensions.

Hollow shell dimensions: an outer diameter of 74 mm, a wall thickness of 8.6 mm, and a length of 2200 mm.

[Evaluation Method]

(1) Life of Plug

Visual inspection was made for a plug at every time when piercing-rolling was completed, and the life of plug was evaluated by the number of passes at a time when melting loss or deformation damages occurred in the front edge portion of plug, that is, the number of the starting materials that were able to be piercing-rolled successively (the number of piercing-rolling in succession).

(2) Inner Surface Flaws

Inner surface flaws were evaluated by the presence or absence of a flaw(s) by visually inspecting the inner surface of each hollow shell that had been formed by piercing-rolling.

[Testing Results]

The results shown in Table 5 indicate the followings.

The plug HH, which was a Comparative Example and in which a scale coating was formed by heat treatment, exhibited 1 pass in the number of piercing in succession, and melting loss was observed in the front edge portion of plug.

The plug AA, which was an Inventive Example of the present invention, was configured such that the spraying distance was fixed at 1000 mm, and the coating thickness was 400 μm both in the front edge portion and the trunk portion. This plug AA exhibited 2 passes in the number of piercing in succession and a longer life than that of the plug HH, which was a Comparative Example.

In each of the plugs BB to GG, Inventive Examples of the present invention, the oxide ratio in the coating was configured to be higher in the surface layer portion than in the base metal side by varying the spraying distance, an equal or longer life than that of the plug HH, which was a Comparative Example, was exhibited.

Among those, the plug BB, in which the coating thickness was 400 μm both in the front edge portion and the trunk portion, exhibited 3 passes in the number of piercing in succession. Moreover, in case of the plugs CC and DD, the coating thickness of the front edge portion was increased to 800 μm in CC and 1200 μm in DD, exhibited an increase in the number of piercing in succession to be 5 passes and 9 passes, respectively.

The plug EE, in which the coating thickness was configured to be 800 μm both in the front edge portion and the trunk portion, exhibited a peeling off in the coating of the trunk portion and was disabled after 1 pass of piercing. This was caused by the fact that the coating thickness of the trunk portion was too large so that the coating is facilitated to be readily peeled off.

In the plugs FF and GG, the coating thickness of the front edge portion in each was 1200 μm whereas the coating thickness of the trunk portion was respectively 300 μm and 200 μm, that is, to be less than 400 μm, and 9 passes and 5 passes in the number of piercing in succession, respectively, were exhibited.

Moreover, in any of the plugs AA to HH, any inner surface flaw was not observed in the obtained hollow shells.

INDUSTRIAL APPLICABILITY

The present invention can be effectively applied to the production of a seamless tube by hot working.

REFERENCE SIGNS LIST

1: piercing machine, 2: plug, 3: mandrel, 4: conical roll, 5: lubricant supply apparatus, 7: starting material, 8: hollow blank, 21: front edge portion, 22: cylindrical portion, 23: trunk portion, 24: lubricant ejection hole, 24*a*: opening, 25:

relief portion, 25*a*: rear edge surface, 26: mandrel joint, 26*a*: bottom surface, 27: coating, 31: through hole, 51: lubricant, 52: tank, 53: pump, and 60: gap.

What is claimed is:

1. A plug for use in a piercing-rolling mill for piercing-rolling a starting material and deforming the same into a hollow blank, the plug being coupled with a front edge of a mandrel and adapted to pierce the starting material while injecting a lubricant, the plug including:

a front edge portion having a convex curvature;

a cylindrical portion having a truly or nearly cylindrical shape;

a trunk portion having an outer diameter gradually increasing toward a rear edge thereof, wherein a first end of the cylindrical portion is adjacent to the front edge portion and a second end of the cylindrical portion is adjacent to the trunk portion, wherein a maximum diameter of the front edge portion is equal to a diameter of the cylindrical portion at the first end of the cylindrical portion;

a mandrel joint provided in a rear edge portion of the plug;

a lubricant ejection hole running through the trunk portion from the mandrel joint that opens on the surface of the cylindrical portion; and a coating comprising oxides and Fe that is formed on the base metal surface of each of the front edge portion as well as the trunk portion by arc spraying using an iron wire, wherein a ratio of regions occupied by the oxides in the coating is not more that 40% in a portion adjacent to the base metal, and 55% to 80% in a surface layer portion.

2. The plug according to claim 1, wherein a thickness of the coating is larger in the front edge portion than in the trunk portion.

3. A plug for use in a piercing-rolling mill for piercing-rolling a starting material and deforming the same into a hollow blank, the plug being coupled with a front edge of a mandrel and adapted to pierce the starting material, the plug including:

a front edge portion having a convex curvature;

a trunk portion having an outer diameter gradually increasing toward a rear edge thereof, the trunk portion directly abutting the front edge portion or otherwise having a cylindrical portion of a truly or nearly cylindrical shape lie between them, wherein a first end of the cylindrical portion is adjacent to the front edge portion and a second end of the cylindrical portion is adjacent to the trunk portion, and wherein a maximum diameter of the front edge portion is equal to a diameter of the cylindrical portion at the first end of the cylindrical portion;

a mandrel joint provided in a rear edge portion of the plug; and a coating comprising oxides and Fe that is formed at least on the base metal surface of each of the front edge portion as well as the trunk portion by arc spraying using an iron wire, wherein a ratio of regions occupied by the oxides in the coating is not more that 40% in a portion adjacent to the base metal, and 55% to 80% in a surface layer portion.

4. The plug according to claim 3, wherein a thickness of the coating is larger in the front edge portion than in the trunk portion.

5. A piercing-rolling mill for piercing-rolling a starting material and deforming the same into a hollow blank while injecting a lubricant from a plug coupled with a front edge of a mandrel, the piercing-rolling mill including:

a mandrel having a through hole in an axial direction;

a lubricant supply apparatus for supplying the lubricant to the through hole; and a plug having a lubricant ejection hole in communication with the through hole, wherein the plug comprises: a front edge portion having a convex curvature; a cylindrical portion having a truly or nearly cylindrical shape; and a trunk portion having an outer diameter gradually increasing toward a rear edge thereof, wherein a first end of the cylindrical portion is adjacent to the front edge portion and a second end of the cylindrical portion is adjacent to the trunk portion, and wherein a maximum diameter of the front edge portion is equal to a diameter of the cylindrical portion at the first end of the cylindrical portion, and wherein the lubricant ejection hole opens on the surface of the cylindrical portion, and wherein a coating comprising oxides and Fe is formed on the base metal surface of each of the front edge portion as well as the trunk portion by arc spraying using an iron wire, wherein a ratio of regions occupied by the oxides in the coating is not more that 40% in a portion adjacent to the base metal, and 55% to 80% in a surface layer portion.

6. The piercing-rolling mill according to claim 5, wherein a thickness of the coating is larger in the front edge portion than in the trunk portion.

7. A method of producing a seamless tube, wherein the piercing-rolling mill according to claim 6 is used, and while the starting material is piercing-rolled, the starting material is deformed into a hollow blank while the lubricant is being injected from the ejection hole of the plug.

8. A method of producing a seamless tube, wherein the piercing-rolling mill according to claim 5 is used, and while the starting material is piercing-rolled, the starting material is deformed into a hollow blank while the lubricant is being injected from the ejection hole of the plug.

* * * * *

UNITED STATES PATENT AND TRADEMARK OFFICE

CERTIFICATE OF CORRECTION

PATENT NO. : 8,544,306 B2
APPLICATION NO. : 13/212929
DATED : October 1, 2013
INVENTOR(S) : Yasuto Higashida et al.

It is certified that error appears in the above-identified patent and that said Letters Patent is hereby corrected as shown below:

On the Title Page:

At item (63), please add
-- Continuation of application No. PCT/JP2010/050668, filed January 21, 2010. --

Signed and Sealed this
Third Day of December, 2013

Margaret A. Focarino

Margaret A. Focarino
*Commissioner for Patents of the United States Patent and Trademark Office*